US006397752B1

(12) United States Patent
Yang et al.

(10) Patent No.: US 6,397,752 B1
(45) Date of Patent: Jun. 4, 2002

(54) METHOD AND APPARATUS FOR COUPLING EXPLOSIVE DEVICES

(75) Inventors: Wenbo Yang, Sugar Land; Robert A. Parrott, Houston, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/481,913

(22) Filed: Jan. 12, 2000

Related U.S. Application Data

(60) Provisional application No. 60/115,651, filed on Jan. 13, 1999.

(51) Int. Cl.[7] ..... C06C 5/04; C06C 5/06; F42B 3/00

(52) U.S. Cl. ..... 102/275.4; 102/275.7; 102/275.11; 102/275.12; 102/312

(58) Field of Search ..... 102/275.4, 275.7, 102/275.11, 275.12, 312, 313

(56) References Cited

U.S. PATENT DOCUMENTS

| | | | | |
|---|---|---|---|---|
| 3,678,853 A | * | 7/1972 | Kilmer | 102/275.4 |
| 4,314,614 A | | 2/1982 | McPhee et al. | 175/4.56 |
| 4,681,037 A | * | 7/1987 | Regalbuto | 102/312 X |
| 4,716,832 A | * | 1/1988 | Sumner | 102/275.12 X |
| 4,742,773 A | * | 5/1988 | Bartholomew et al. | 102/275.12 X |
| 4,984,500 A | * | 1/1991 | Aseltine et al. | 102/313 |
| 5,007,344 A | | 4/1991 | Richles et al. | 102/313 X |
| 5,046,567 A | | 9/1991 | Aitken et al. | 175/4.56 |
| 5,123,356 A | * | 6/1992 | Brooks et al. | 102/275.4 X |
| 5,155,293 A | | 10/1992 | Barton | 102/312 |
| 5,355,802 A | * | 10/1994 | Petijean | 102/312 X |
| 5,483,895 A | * | 1/1996 | Tomek et al. | 102/312 |
| 5,661,256 A | * | 8/1997 | Sutula, Jr. et al. | 102/275.4 |
| 5,747,722 A | * | 5/1998 | Gladden et al. | 102/275.11 |

FOREIGN PATENT DOCUMENTS

| | | | | |
|---|---|---|---|---|
| AU | 648577 | * | 2/1992 | 102/275.4 |

* cited by examiner

*Primary Examiner*—Peter A. Nelson
(74) *Attorney, Agent, or Firm*—Trop, Pruner & Hu P.C.

(57) ABSTRACT

A gun system in one arrangement includes a first carrier including a detonating cord and a second carrier including a detonating cord. An adapter couples the first and second carriers, with the adapter including an explosive coupled to the detonating cord of one of the first and second carriers. The explosive is positioned in a reduced housing portion of the adapter. The reduced housing portion of the adapter has a first outer diameter less than an inner diameter of the first carrier to provide a predetermined annular space between the reduced adapter portion and the inner diameter of the first carrier. At least one of the detonating cords in the first and second carriers is attached to a retainer element, and the retainer element is placed in close proximity to the explosive to maintain an axial position of the detonating cord to reduce separation between the detonating cord and the explosive. In addition, the explosive is placed some axial distance away from sensitive elements in the adapter, such as sealing elements and connector elements, to protect the sensitive elements from detonation of the explosive.

18 Claims, 5 Drawing Sheets

METHOD AND APPARATUS FOR COUPLING EXPLOSIVE DEVICES

This application claims priority under 35 U.S.C. §119(e) to U.S. Provisional Application Serial No. 60/115,651, entitled "Coupling Adapters," filed Jan. 13, 1999.

BACKGROUND

The invention relates to methods and apparatus for coupling explosive devices in tools for use in well bores.

After a well has been drilled and casing has been cemented in the well, one or more sections of the casing may be perforated using perforating guns. After a perforating gun string is lowered into the well to a desired depth, the guns in the string arc fired to create openings in the casing and to extend perforations into the surrounding formation. Production fluids in the perforated formation can then flow through the perforations and the casing openings into the well bore.

A gun string may include one or more carriers each housing a number of shaped charges coupled to a detonating cord. To fire the shaped charges, the detonating cord is initiated, with the detonation wave traveling through the cord detonating successive shaped charges connected to the cord. A connector sub or adapter couples one gun carrier to the next. To transfer a detonation wave carried by the detonating cord in one gun carrier to the detonating cord of a successive gun carrier, the connector sub or adapter conventionally includes booster explosives that are coupled to the detonating cords. In one arrangement, the detonation wave transmitted down a detonating cord in a first gun carrier is transferred to a donor booster explosive in the adapter. In turn, the donor booster explosive initiates a detonation wave in a receptor booster explosive, which transfers the detonation wave to the detonating cord of the next gun carrier.

Due to tensile forces imposed on the detonating cord resulting from such forces as mechanical loading, tool vibration, and thermal expansion or shrinkage, physical separation of the detonating cords from their respective booster explosives may occur. This reduces the reliability of the transfer of a detonation wave between a booster explosive and a detonating cord in conventional connector subs or adapters.

In addition, detonation of a booster explosive may cause damage to an adapter. A typical adapter may include O-ring seals, threaded connectors, and other elements that when damaged prevent reuse of the adapter. This increases the cost of well operations since damaged adapters must be replaced, sometimes after only a small number of uses.

A need thus exists for an improved coupling method and apparatus for explosive devices in tools, such as perforating gun strings, for use in well bores.

SUMMARY

In general, according to one embodiment, a gun system includes a first carrier including a detonating cord and a second carrier including a detonating cord. An adapter couples the first and second carriers, with the adapter including an explosive coupled to the detonating cord of one of the first and second carriers. The explosive is positioned in a reduced housing portion of the adapter. The reduced housing portion of the adapter has a first outer diameter less than an inner diameter of the first carrier to provide a predetermined annular space between the reduced adapter portion and the inner diameter of the first carrier.

In general, according to another embodiment, a tool includes a detonating cord, an explosive coupled to the detonating cord, and a retainer element spaced apart from the explosive and attached to the detonating cord. The retainer element is positioned in the tool to reduce longitudinal movement of the detonating cord away from the explosive.

In general, according to yet another embodiment, an adapter for coupling to a tool includes one or more housing sections and at least one of a scaling element and a connector element contained in the one or more housing sections. Further, an explosive is positioned a predetermined axial distance in the one or more housing sections away from the at least one of a sealing element and a connector element to protect the elements from detonation of the explosive.

Other features and embodiments will become apparent from the following description, the drawings, and the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "upstream" and "downstream"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
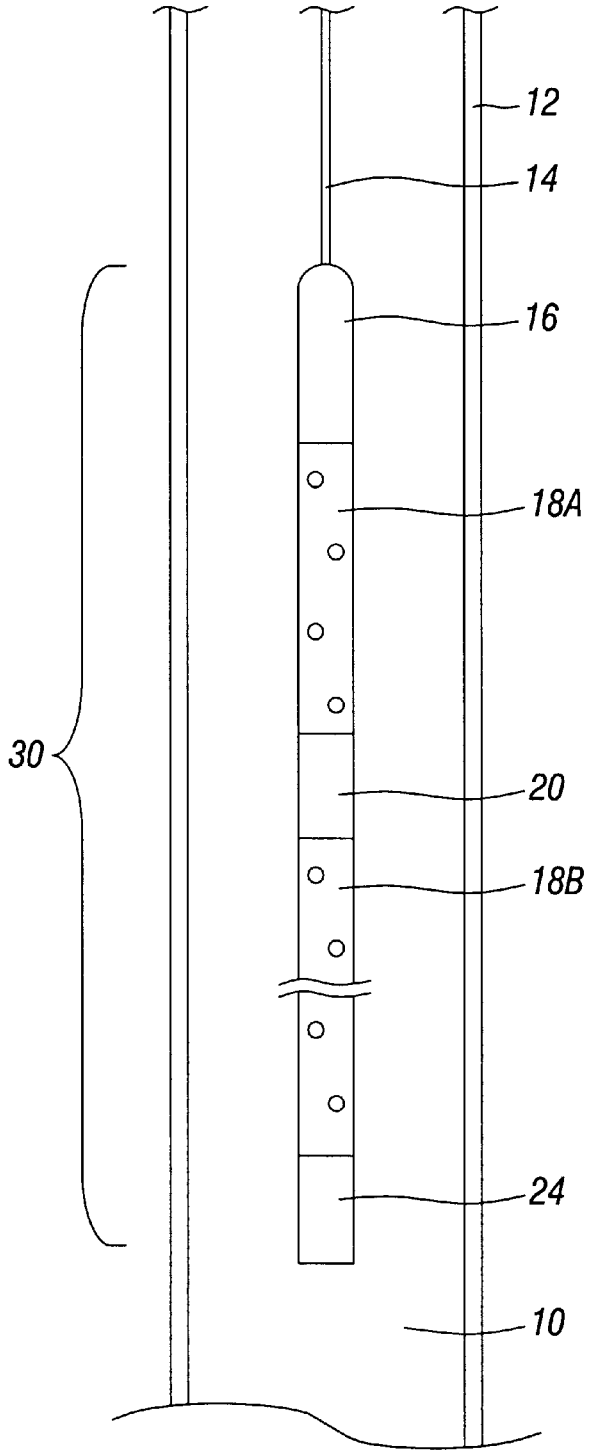
FIG. 1 is a diagram of a perforating gun system according to an embodiment positioned in a wellbore.

Referring to FIG. 1, a perforating gun system 30 according to one embodiment is positioned in a well bore 10 that may be lined with casing 12. The gun system 30 includes perforating gun carriers 18A and 18B that are coupled by an adapter 20. As used here, "adapter" refers to any mechanism that can be used to connect or couple two components. Additional gun carriers may be included in the gun system 30, with additional adapters coupling the gun carriers.

The gun carriers 18A and 18B may include loading tubes in which shaped charges are contained. Alternatively, the gun carriers 18A and 18B may include strips onto which capsule shaped charges are mounted. The lower gun carrier 18B is coupled to a lower sub 24, and the upper gun carrier 18A is coupled to a firing head 16. The firing head 16 may be coupled to a wire line, coiled tubing, or some other conveying mechanism 14.

The adapter 20 according to one embodiment may have one or more improved features over those of conventional adapters. One feature is an independent support mechanism for a detonating cord in a gun carrier that maintains the position of the detonating cord to reduce the likelihood of physical separation between the detonating cord and booster explosive (and thus maintain a reliable ballistic engagement of the cord and the booster explosive) due to various tensile forces. Such tensile forces may result from mechanical loading of the cord, vibrations when lowering the perforating gun system into a well bore, and thermal expansion and shrinkage of the detonating cord due to increased down hole temperatures.

Another feature of the adapter 20 is that one or more booster explosives may be located in predetermined sections of the adapter (hereinafter referred to as "adapter booster sections") to avoid damage to certain elements of the adapter 20 when a booster explosive is detonated. For example, the adapter 20 may include sealing elements (e.g., O-ring seals), connector elements (e.g., threaded connectors, fasteners, and other types of connectors), and other elements that may be easily damaged by detonation of a booster explosive in the adapter 20. To reduce the likelihood of damage to the adapter 20 that would render it unusable, a booster explosive is located in an adapter booster section away from sensitive elements of the adapter 20. As used here, "sensitive elements" refer to elements that when damaged render the adapter unusable. Locating the booster explosive away from the sensitive element improves the ability to reuse the adapter in subsequent runs in other gun systems, thereby reducing the cost of down hole equipment. In addition, reliability of the gun system is improved since the adapter would be less likely to fail when it is lowered down hole. Failure of the adapter may result in the entire gun system being unusable as the gun system may flood with well fluids when seals are compromised or threaded connectors are not tightened.

Further, the adapter booster section has a reduced outer diameter with respect to other portions of the adapter 20. With each detonation of a booster explosive, the outer diameter of the adapter booster section is increased by some amount. The original outer diameter of the adapter booster section may be sized to allow up to some number (e.g., 10) of booster explosive detonations before the outer diameter of the adapter booster section exceeds the inner diameter of a housing (e.g., gun carrier housing) in which the adapter booster section is contained. This allows the adapter 20 to be re-used an increased number of times.

Yet another feature of the adapter 20 according to an embodiment is the coupling mechanism between the adapter 20 and the gun carriers. The coupling mechanism includes keys to align and lock the adapter 20 and the gun carrier so that the relative orientation of the adapter 20 and gun carrier may be conveniently controlled. Using the coupling mechanism, one gun carrier can be conveniently aligned to the next carrier to provide a desired phasing of shaped charges. In addition, several different coupling mechanisms having different key configurations may provide for different increments of control (e.g., 5°, 45°, 90°, and so forth).

Embodiments of the invention may include one or more of such improved features. In the description that follows, an embodiment is described that includes all the listed features, although certain features may be omitted in other embodiments.

Figure 2:
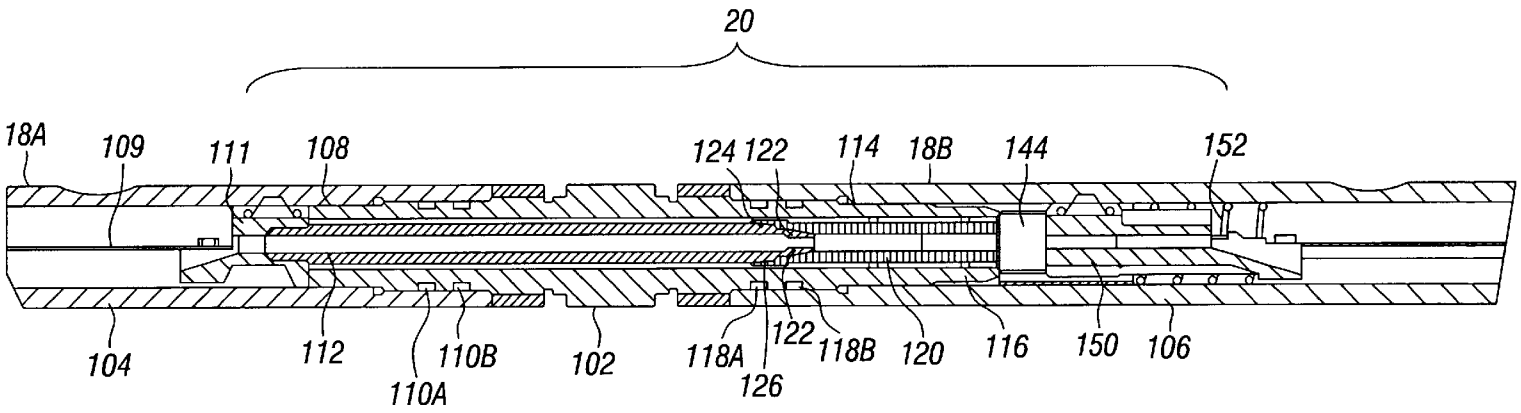
FIGS. 2 and 3 are longitudinal sectional views of portions of the gun system of FIG. 1 including an adapter for coupling two gun carriers.
Figure 3:
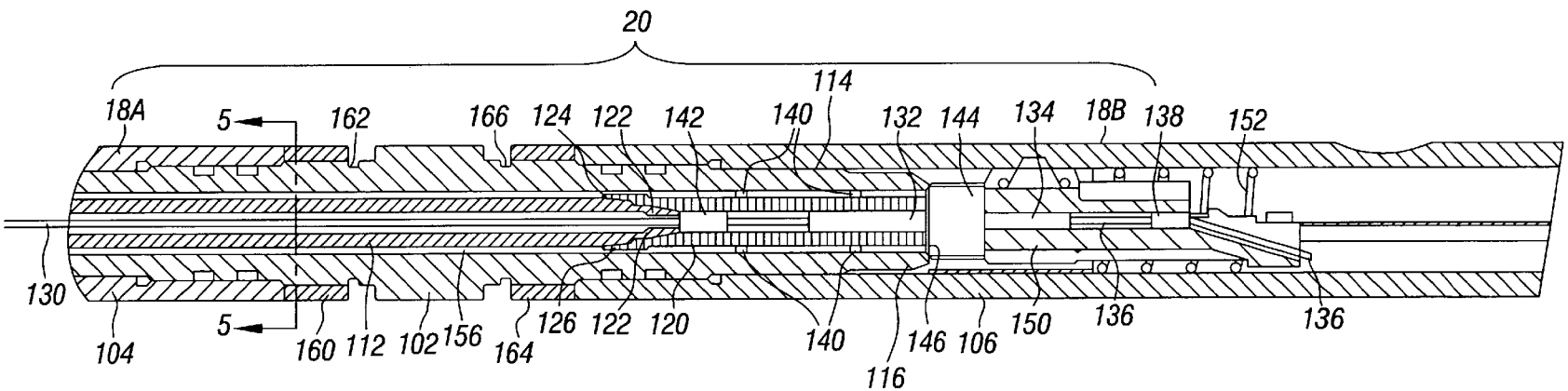

FIG. 2 illustrates the adapter 20 and portions of the gun carriers 18A and 18B without the detonating cords, shaped charges, and booster explosives. FIG. 3 is a slightly more enlarged view of the gun carriers and adapter with the detonating cords 130 and 136, donor booster explosive 132, and receptor booster explosive 134 shown.

The adapter 20 includes a housing section 102, which may be made of a suitable metal such as steel or a steel alloy. In the illustrated embodiment, the upper side (left on the diagram) of the adapter 20 has a threaded portion 108 connected to the housing 104 of the gun carrier 18A. A pair of O-ring seals 110A and 110B carried by the adapter housing 102 provides a sealed connection. A tubular member 112 (referred to as the "donor extension member"), which may be made of plastic or other suitable material, is positioned in the inner bore of the adapter housing section 102. The donor extension member 112 includes a bore in which the detonating cord 130 (FIG. 3) is passed through.

The upper end of the donor extension member 112 is connected to a donor module 111, which is in turn connected to a strip 109 contained in the gun carrier housing 104. Shaped charges (not shown) are mounted to the strip 109.

Figure 4A:
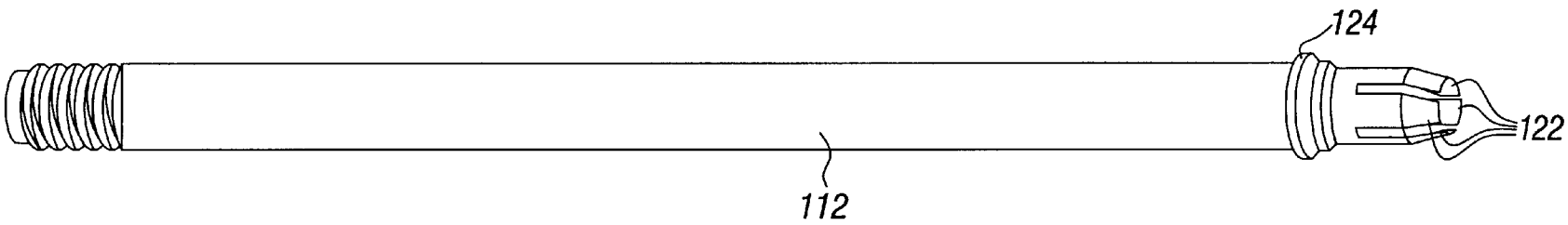
FIGS. 4A and 4B illustrate housing sections in the adapter of FIGS. 2 and 3 for housing a portion of a detonating cord and a booster explosive.
Figure 4B:
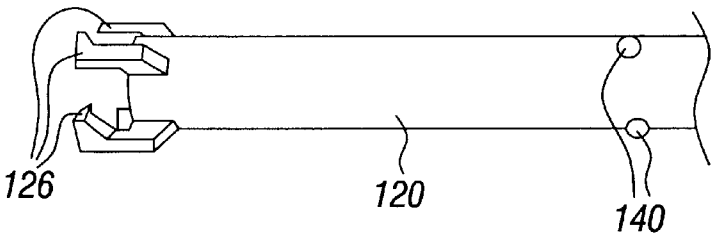

The lower end of the donor extension member 112 includes a number of fingers 122 (further shown in FIGS. 4A and 4B) that are adapted to enter the upper portion of a donor housing 120, which may be made of plastic or other suitable material. The donor housing 120 is also generally tubular in shape with a bore to receive the detonating cord 130 (FIG. 3). The donor housing 120 is contained within the adapter housing section 102 in the illustrated embodiment.

The donor extension member 112 includes a flange portion 124 over which clips 126 on the donor housing 120 can latch onto to couple the donor extension member 112 to the donor housing 120. Centralizers 140 are located on the outer wall of the donor housing 120 to locate the donor extension member 112 and donor housing 120 generally in the center of the adapter housing section 102.

As shown in FIG. 3, the detonating cord 130 from the gun carrier 18A extends through the inner bore of the donor extension member 112 and donor housing 120. A hollow crimping shell 142 around a portion of the detonating cord 130 is positioned in the bore of the donor housing 120. The crimping shell 142 is crimped to the detonating cord 130. One end of the crimping shell 142 is abutted against the fingers 122 at the end of the donor extension member 112. The fingers 122 prevent movement of the crimping shell 142 in the upstream direction. The lower end of the detonating cord 130 is contacted to a booster explosive 132, which may be attached inside another crimping shell. The booster explosive 132 may be located in the bore of the donor housing 120.

The crimping shell 142 provides an independent mechanism by which the detonating cord 130 is held in place to reduce the likelihood of physical separation between the detonating cord 130 and the booster explosive 132 due to various tensile forces on the detonating cord.

In further embodiments, instead of the crimping shell 142, other types of retainer elements or mechanisms may be used. Such retainer elements are placed in close proximity to the explosive to enhance the ability to maintain the axial position of the detonating cord with respect to the booster explosive. "Close proximity" refers to the positioning of the detonating cord within the same adapter.

A gap 144 is formed between the donor booster explosive 132 and the receptor booster explosive 134, which is located in a receptor module 150 (also part of the adapter 20). The top end of the receptor module 150 may also be spaced apart from the bottom end of the adapter housing 102 by the gap 144. The receptor booster explosive 134 may be contained in a crimping shell. A flying plate 146 (which may be made of aluminum or other suitable material) is located adjacent the donor booster explosive 132. The flying plate 146 is capable of traversing the gap 144 in response to a detonation wave carried through the donor booster explosive 132 to impact the exposed end of the receptor booster explosive 134. The other end of the receptor booster explosive 134 is in contact with a detonating cord 136, located at the lower part of the bore of the receptor module 150. The receptor module 150 is held in place inside the gun carrier housing 106 by a coiled spring 152.

A hollow crimping shell 138 inside the receptor module 150 is crimped around a portion of the detonating cord 136 to hold it in place. The receptor module 150 includes a shoulder at its bottom end to hold the crimping shell 138 inside the receptor module 150. As is the case on the donor side, the crimping shell 138 provides an independent mechanism by which the detonating cord 136 is held in place to reduce the likelihood of physical separation between the detonating cord 136 and the receptor booster explosive 134 due to various tensile forces on the detonating cord 136. In further embodiments, other types of retainer elements or mechanisms may be used for detonating cord 136.

For enhanced protection of the adapter 20, an annulus region 156 around the donor extension member 112 and donor housing 120 in conjunction with the walls of the donor extension member 112 and donor housing 120 reduce the magnitude of shock waves caused by detonation of the detonating cord 130 and booster explosive 132. As a result, likelihood and extent of damage to the inner walls of the adapter housing 102 is reduced.

The lower side of the adapter 20 has a threaded portion 114 to connect to the housing 106 of the lower gun carrier 18B. A pair of O-ring seals 118A and 118B are carried by the adapter housing 102 to provide a sealed connection. The end portion of the adapter housing section 102 includes a booster section 116 adapted to receive a booster explosive 132 (FIG. 3). The booster section 116 has an outer diameter that is less than the inner diameter of the carrier housing 106 to provide a gap between the booster section 116 and carrier housing 106. The booster section 116 is longitudinally or axially spaced apart from the threaded portion 114 and seals 118A and 118B in the adapter 20 by some predetermined spacing. This predetermined spacing between the boosting explosive 132 and the threaded portion 114 and seals 118A and 118B reduces the likelihood of damage to those elements of the adapter 20 due to detonation of the booster explosive 132.

Further, with each detonation of the booster explosive 132, the outer diameter of the booster section 116 increases by some amount. In one example configuration, the outer diameter of the booster section 116 is less than the inner diameter of the carrier housing 106 by about 0.040 inches. Each detonation of the booster explosive 132 may cause the outer diameter of the booster section 116 to increase by about 0.004 inches. Thus, in this example, the adapter 20 may be reused 10 times before the outer diameter of the booster section 116 exceeds that of the threaded portion 114. When that occurs, the outer wall of the booster section 116 may be shaved to again provide some clearance so that the adapter 20 may be reused several more times.

Figure 5:
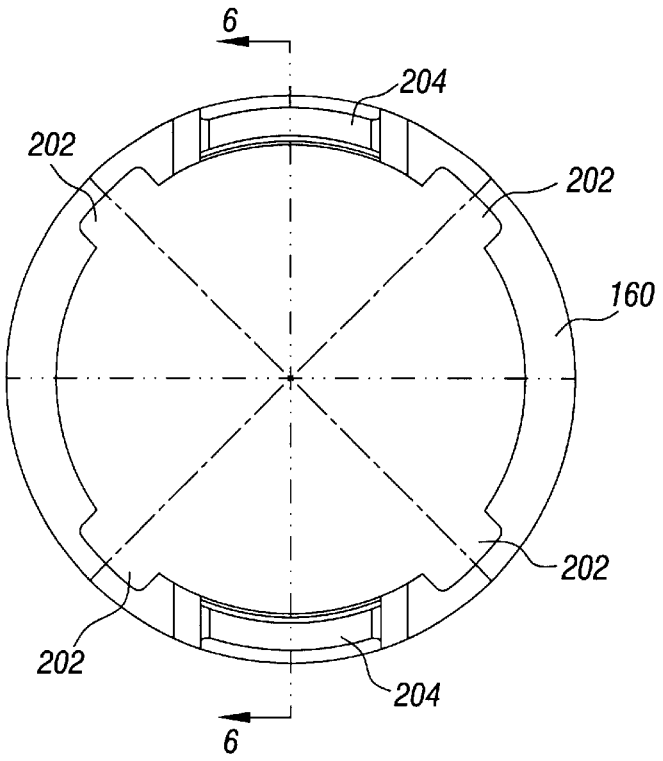
FIGS. 5 and 6 are cross-sectional views of a lock ring in the perforating gun system of FIG. 1.
Figure 6:
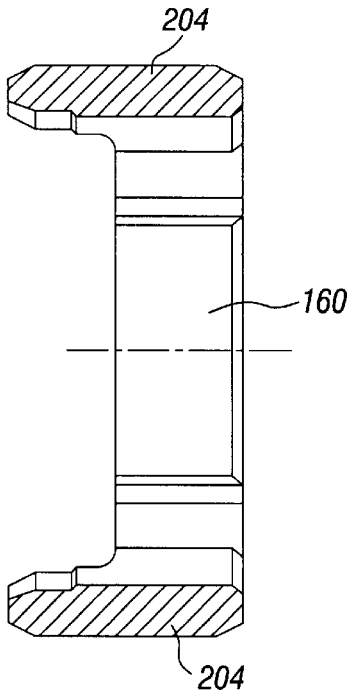

The adapter housing 102 is locked against the upper gun carrier housing 104 by a lock ring 160. A cross-section of the lock ring 160 is shown in FIG. 5. The lock ring 160 includes several slots 202 that are adapted to receive keys in the outer wall of the adapter housing 102. In addition, the lock ring 160 includes a pair of lock members 204 that are adapted to fit into corresponding notches in the gun carrier housing 104. The slots 202 on the lock ring 160 and corresponding keys on the adapter housing 102 effectively lock the ring 160 to the adapter 20. The lock members 204 on the lock ring 160 and the corresponding notches in the gun carrier housing 104 lock the ring 160 to the housing 104. Thus, using the lock ring 160 according to an embodiment, the gun carrier 18A can be locked and aligned to the adapter 20.

In an alternative embodiment, the lock ring 160 may instead include keys that are coupled to corresponding slots in the adapter housing 102. Also, the lock ring 160 may include notches to receive lock members in the gun carrier housing 104.

The lock ring 164 is constructed similarly to the lock ring 160 and is adapted to lock and align the adapter 20 to the lower gun carrier housing 106. Once the lock rings 160 and 164 are fitted over the adapter 20 and gun carriers 18A and 18B in a desired manner, C-rings can be fitted into grooves 162 and 166 (FIG. 3) in the adapter housing 102 to fix the lock rings 160 and 164, respectively, in place. Using the lock rings 160 and 164 according to embodiments of the invention, a convenient coupling mechanism is provided to lock and align the adapter 20 to the gun carriers 18A and 18B. By using the lock rings, cap screws to align the adapter to gun carriers can be avoided.

Figure 7:
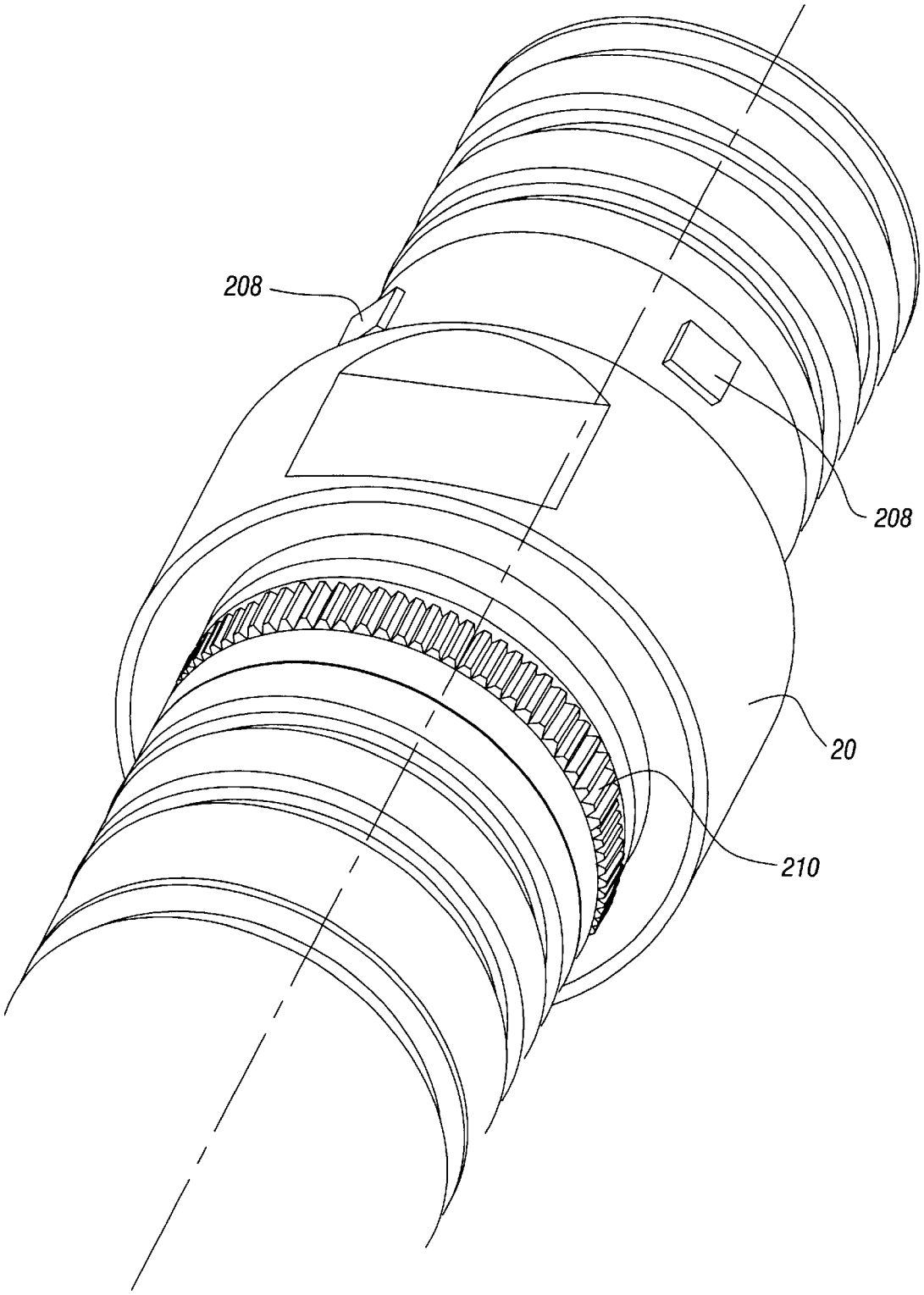
FIG. 7 illustrates keys in the outer wall of the housing of an adapter according to one embodiment for use with the lock ring of FIGS. 5 and 6.

There may be a varying number of slots 202 in the lock ring 160 or 164 to provide different increments of control. As illustrated in FIG. 5, the four slots 202 provide for 90° increments. These four slots may be fitted over keys 208 on the adapter housing 102 as illustrated in FIG. 7. If finer increments are desired, a lock ring with more slots may be provided. For example, 72 slots in the lock ring provides 5° increments. An adapter with 72 corresponding keys 210 is illustrated in FIG. 7.

In operation, a gun string is assembled at the surface with one or more adapters 20 used to connect successive gun carriers. Using lock rings such as 160 and 164, a desired phasing pattern of shaped charges may be accomplished by orienting successive gun carriers in a desired orientation. Once assembled, the gun string may be inserted into the well bore 10. As the gun string is lowered, it may be subjected to various forces, including a tensile force applied by the weight of the gun string itself, forces due to impact of certain portions of the gun string to other down hole equipment (e.g., production tubing and casing), vibrational forces, and loads experienced due to the increase in temperature in the well bore 10. In conventional gun systems, such forces may work to separate detonating cords from booster explosives in adapters connecting gun carriers. When such separation occurs, the firing reliability of the gun string is reduced. Using some embodiments of the invention, retainer mechanisms are used to hold the place of the detonating cord with respect to the booster explosive it is in contact with. In one embodiment, the retainer mechanism may include a crimping shell crimped to the detonating cord, with the crimping shell in abutment with some other fixed surface within the adapter 20. By reducing separation of detonating cords and booster explosives within a gun string, reliability is enhanced.

When the gun string is lowered to a desired depth, a detonating cord is initiated by the firing head 16, with the resultant detonation wave firing successive shaped charges as the detonation wave travels down the detonating cord. As shown in FIG. 3, when the detonation wave in the detonating cord 130 reaches the donor booster explosive 132, the booster explosive 132 explodes. This causes a force applied against the plate 146 to send the plate across the gap 144. Impact of the plate 146 with the receptor booster explosive 134 causes the booster explosive 134 to explode, which initiates a detonation wave in the detonating cord 136. The detonation wave travels down detonating cord 136 to fire shaped charges in the next gun carrier.

The walls of the donor housing 120 and the annulus region 156 outside the donor housing 120 provides some protection (from detonation of the donor booster explosive 132 and detonating cord 130) for the inner wall of the adapter housing 102. Thus, damage within the adapter housing section 120 is reduced. Explosion of the donor booster explosive 132 does cause a radial force to be applied against the adapter booster section 116. As a result, the donor booster section 116 is designed with a reduced outer diameter (as compared to the outer diameter of the rest of the adapter housing 102) so that a gap is provided between the outer wall of the donor booster section 116 and the inner wall of the carrier housing 106. This allows expansion of the donor booster section 116. After the gun string has been fired, the gun string can be retrieved to the surface, with the adapter 20 re-used in the next gun string until deformation of the donor booster section 116 has rendered the adapter 20 no longer useable. Re-usability of the adapter 20 is also enhanced by the fact that the donor booster explosive 132 is located some axial distance away from sensitive components (e.g., O-ring seals and threads) of the adapter 20.

Although described in conjunction with perforating gun strings, adapters 20 or modifications or variations thereof may be used with other types of tools that may include explosive devices. While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A gun system comprising:

a first carrier including a detonating cord;

a second carrier including a detonating cord; and an adapter coupling the first and second carriers, the adapter including an explosive coupled to at least one of the detonating cord of one of the first and second carriers, the adapter having an outer housing comprising a reduced housing portion, the explosive being positioned in the reduced housing portion of the adapter, the reduced housing portion of the adapter having a first outer diameter less than an inner diameter of the first carrier to provide a predetermined annular space between an outer surface of the reduced housing portion and the inner diameter of the first carrier.

2. A gun system comprising:

a first carrier including a detonating cord;

a second carrier including a detonating cord; and an adapter coupling the first and second carriers, the adapter including an explosive coupled to the detonating cord of one of the first and second carriers, the explosive being positioned in a reduced housing portion of the adapter, the reduced housing portion of the adapter having a first outer diameter less than an inner diameter of the first carrier to provide a predetermined annular space between the reduced housing portion and the inner diameter of the first carrier, wherein the reduced housing portion is adapted to expand by a predetermined amount with the detonation of the explosive to enable reuse of the adapter in a subsequent shot.

3. The gun system of claim 1, wherein the adapter has a second housing portion contained within the first carrier housing, the second housing portion having an outer diameter greater than the first outer diameter.

4. The gun system of claim 1, further comprising a generally tubular member having a bore, the explosive positioned in the bore.

5. The gun system of claim 4, wherein an annular space is defined between the generally tubular member and the adapter housing to provide protection for the adapter housing from detonation of the explosive.

6. A gun system comprising:

a first carrier including a detonating cord;

a second carrier including a detonating cord; and an adapter coupling the first and second carriers, the adapter including an explosive coupled to the detonating cord of one of the first and second carriers, the explosive being positioned in a reduced housing portion of the adapter, the reduced housing portion of the adapter having a first outer diameter less than an inner diameter of the first carrier to provide a predetermined annular space between the reduced housing portion and the inner diameter of the first carrier, wherein the adapter further includes a connector mechanism to connect the adapter to one of the first and second carriers, the explosive being placed a predetermined axial distance away from the connector mechanism to protect the connector mechanism to enable reuse of the adapter.

7. The gun system of claim 6, wherein the connector mechanism includes a threaded connector.

8. A gun system comprising:

a first carrier including a detonating cord;

a second carrier including a detonating cord; and an adapter coupling the first and second carriers, the adapter including an explosive coupled to the detonating cord of one of the first and second carriers, the explosive being positioned in a reduced housing portion of the adapter, the reduced housing portion of the adapter having a first outer diameter less than an inner diameter of the first carrier to provide a predetermined annular space between the reduced housing portion and the inner diameter of the first carrier, wherein the adapter includes at least one sealing element, the explosive being placed a predetermined axial distance away from the sealing element to protect the sealing element to enable reuse of the adapter.

9. The gun system of claim 1, wherein at least one of the detonating cords in the first and second carriers is attached to a retainer element, the retainer element placed in close proximity to the explosive to maintain an axial position of the detonating cord to reduce separation between the detonating cord and the explosive.

10. The gun system of claim 9, wherein the retainer element includes a crimping shell crimped to the detonating cord and a component in abutment with the crimping shell.

11. The gun system of claim 10, further comprising a generally tubular element having a bore, the crimping shell positioned in the bore, and the component including one or more fingers extending at least partially into the bore to abut the crimping shell.

12. The gun system of claim 10, wherein the adapter further comprises a generally tubular element having a bore, the crimping shell positioned in the bore, the generally tubular element defining a protruding portion in abutment with the crimping shell.

13. The gun system of claim 1, wherein each of the first and second carriers and the adapter has a lock member, the gun system further comprising one or more lock rings coupling the adapter to the first and second carriers and using the lock members of the first and second carriers and the adapter to orient the first and second carriers.

14. The gun system of claim 1, wherein the predetermined annular space provides a gap between the outer surface of the reduced housing portion and an inner surface of the first carrier such that no contact occurs between the reduced housing portion and the inner surface of the first carrier.

15. The gun system of claim 1, further comprising:

a flying plate in abutment with the explosive; and a gap through which the flying plate is adapted to traverse in response to detonation of the explosive.

16. The gun system of claim 15, further comprising a receptor explosive adapted to detonate in response to impact by the flying plate.

17. A system comprising:

a first carrier having a first detonating cord;

a second carrier having a second detonating cord;

an adapter coupling the first and second carriers, the adapter having a booster explosive coupled to at least one of the first and second detonating cords, the adapter hiving a reduced housing portion in which the booster explosive is positioned;

a flying plate in abutment with the booster explosive; and a gap adjacent the flying plate through which the flying plate traverses in response to detonation of the booster explosive.

18. The system of claim 17, further comprising a receptor explosive at one end of the gap, the receptor explosive adapted to be impacted by the flying plate after the flying plate traverses the gap.

* * * * *